United States Patent [19]

Rodenchuk et al.

[11] 3,933,192

[45] Jan. 20, 1976

[54] SEMI-CONTINUOUS CASTING METHOD FOR FLAT INGOTS

[75] Inventors: William Simon Rodenchuk, Montreal; Anthony Garth Eccles, Oakville, both of Canada

[73] Assignee: Alcan Research and Development Limited, Montreal, Canada

[22] Filed: Apr. 30, 1974

[21] Appl. No.: 465,552

[30] Foreign Application Priority Data

Apr. 30, 1973 United Kingdom ..... 20553/73

[52] U.S. Cl. ..... 164/89; 164/82; 164/280

[51] Int. Cl.[2] ..... B22D 11/16

[58] Field of Search ..... 164/82, 87, 273, 280

[56] References Cited

UNITED STATES PATENTS

| | | | |
|---|---|---|---|
| 3,125,786 | 3/1964 | Savage | 164/280 X |
| 3,667,534 | 6/1972 | Kanokogi et al. | 164/83 |

FOREIGN PATENTS OR APPLICATIONS

| | | | |
|---|---|---|---|
| 1,191,070 | 5/1970 | United Kingdom | 164/82 |
| 32,173 | 8/1972 | Japan | 164/273 |

*Primary Examiner*—Robert D. Baldwin

*Attorney, Agent, or Firm*—Cooper, Dunham, Clark, Griffin & Moran

[57] ABSTRACT

In the direct chill semi-continuous casting of an ingot of rectangular cross-section, the formation of convexly curved surfaces on the wider faces of the ingot is avoided, along the full length of the ingot, by progressively increasing the gap at least between the mid-points of the longer sides of the rectangular mould, without substantially altering the gap between the ends of said sides, as the rate of advance of the ingot through the mould increases from a relatively low initial speed. The mould is cooled and coolant is applied directly to the surface of ingot emerging from the mould. In an apparatus for putting the above method into practice, means is provided for varying the curvature of the long side walls of the mould progressively during a casting operation by the application of a flexing force arranged symmetrically with respect to the mid-point of each of the long sidewalls, the ends of the said side walls being restrained from transverse movement.

3 Claims, 4 Drawing Figures

Figure 1:
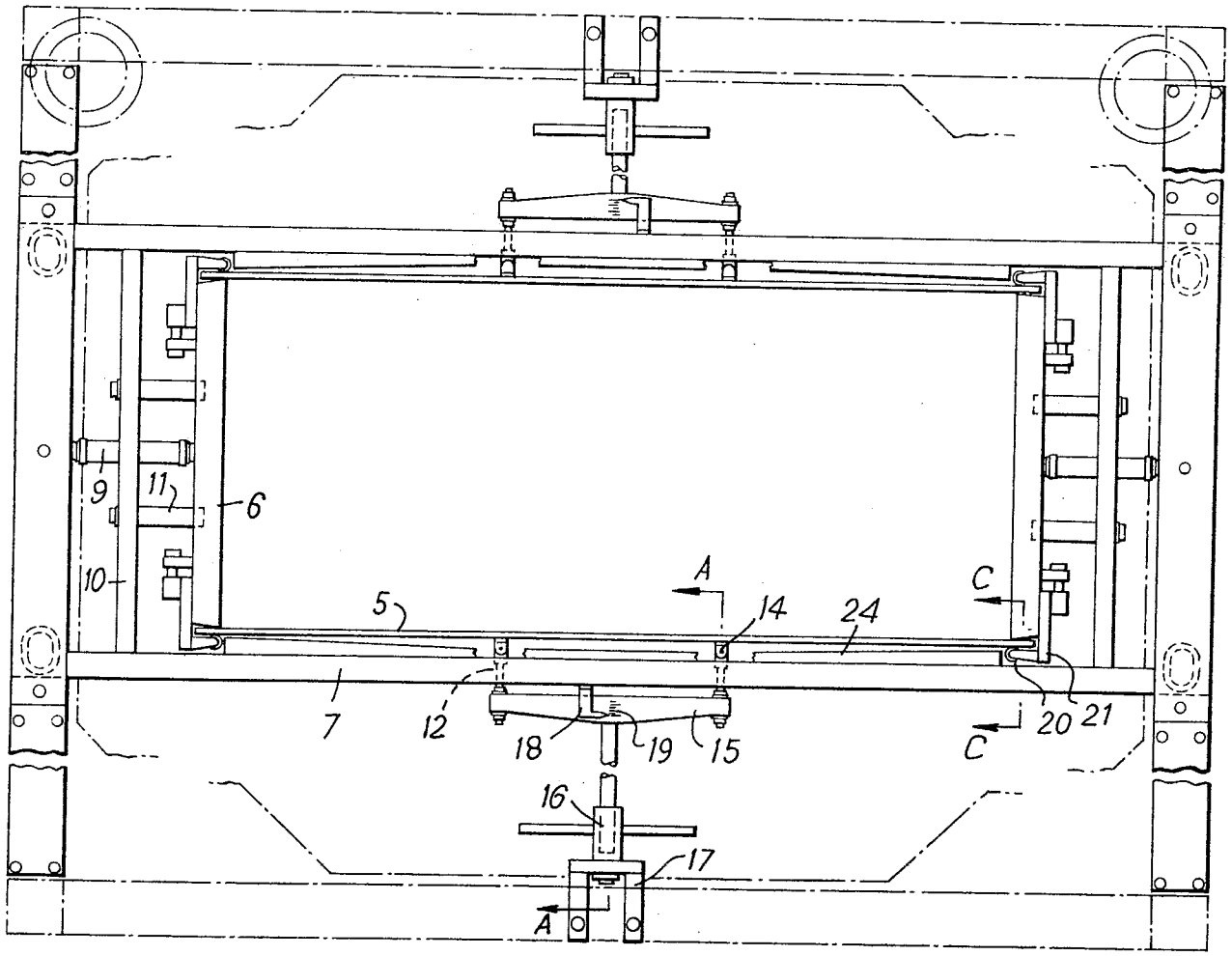

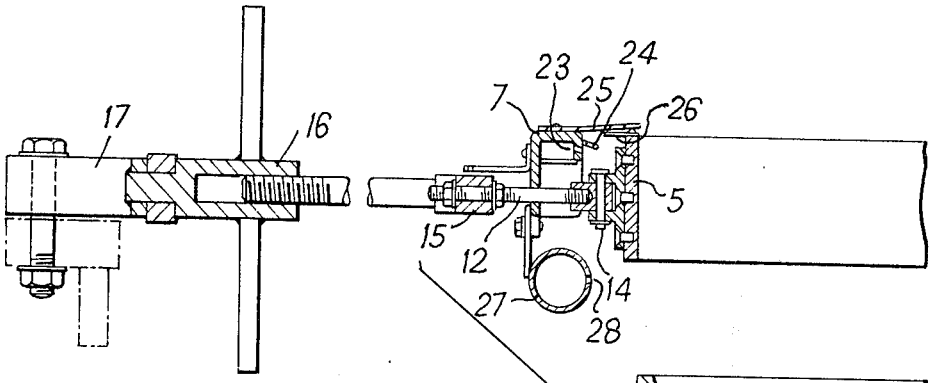
FIG. 2
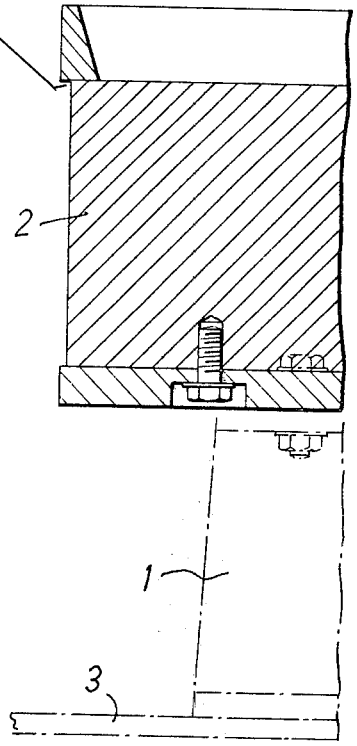
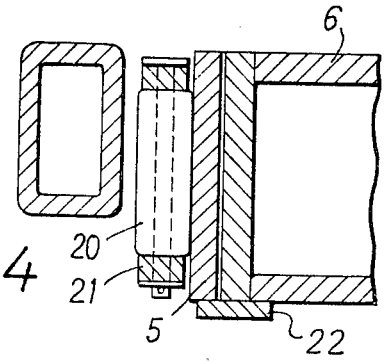
FIG. 4
FIG. 3
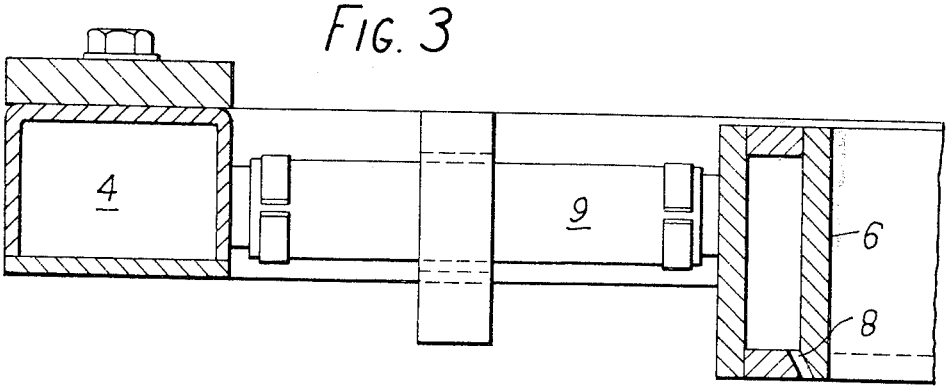

SEMI-CONTINUOUS CASTING METHOD FOR FLAT INGOTS

The present invention relates to apparatus for the production of metal ingots, particularly aluminium and aluminium alloy ingots, by the direct chill semi-continuous casting process, that is to say, to a process in which ingots are produced by pouring metal into an open-ended mould and applying coolant, usually water, directly to the solidified surface of the metal as it emerges from the mould.

In the production of large rectangular-section ingots for the production of rolled products, it is customary to impart a small amount of convex curvature to the long side walls of the mould to counteract the greater metal shrinkage which takes place near the middle of the wide faces of the ingot during solidification as compared with locations near the narrow faces of the ingot. By the use of these conventional moulds in which the distance between the wide faces is greatest at their mid-points, the upper parts of the wide faces of the ingot are controlled to an acceptable condition of flatness. However, the butt end of the ingot is formed when the rate of pouring molten metal is relatively low and, as a consequence, in the butt portion of the ingot the wide faces exhibit an undesirable amount of convexity when the above-mentioned conventional moulds are employed. Before an ingot is rolled it is customary to scalp the surface to remove surface defects and thus form a relatively smooth rolling face. The presence of a thick convex butt end frequently makes it necessary to scalp the wide faces of the ingot at the butt end to remove this convexity before a rolling face scalp cut can be made. The presence of the convexity near the butt end also leads to a safety hazard when the unscalped ingots are stacked.

In order to overcome this difficulty, according to the present invention, each wide side wall of a mould for casting a rectangular-section ingot by the D.C. (direct chill) semicontinuous casting process is made flexible and is provided with means for controlling the bowing of the side wall. Such means most conveniently takes the form of a screw jack acting on the side wall at one or more positions symmetrically disposed in relation to the mid-point of the wall, by the operation of which bowing may be progressively applied to the side wall to flex it from an initial flat or slightly bowed condition at the beginning of the casting operation to an appropriately more pronounced bowed contour by the time the maximum dropping rate of the casting table has been reached. Alternatively the bowing function may be performed by hydraulic means. Indeed many other mechanical, electro-mechanical and pneumatic devices suggest themselves for this purpose. Whatever expedient is adopted, it is preferred that the device for flexing the mould wall is automatically controlled so that the amount of bowing is kept in step with the rate at which the casting table is lowered.

Each flexible mould wall member is associated with a means for applying sub-mould cooling, i.e. the application of coolant directly to the solidified surface of an ingot emerging from the mould and means are also provided for cooling the mould wall itself. For this purpose the flexible mould wall member may be associated with, but relatively movable in relation to, a water supply conduit, which is formed with at least one aperture in the form of a continuous slit or row of orifices for directing water onto the reverse face of the flexible wall member.

Where the ingot cast is of generally square section or where the difference in dimension between the wider faces and narrower faces is small it may be advantageous for the four wall members, defining the rectangular mould aperture, to be flexible and provided with means for applying a controllable amount of bowing. More usually it is satisfactory for the production of rolling ingots, of which the thickness is relatively small in relation to the wide face, to provide the mould with a pair of rigid end wall members to define the narrow end faces of the ingot. The end wall members may be in the form of conventional water boxes with conventional water-emission slots or jets for the application of sub-mould cooling. These end members may be fixed or may be constructed so as to be movable towards and away from each other. The flexible side wall members of the mould, which define the wide rolling faces of the ingot, preferably take the form of thick strips of a metal having high heat-conductivity, such as copper or aluminium. Conveniently the side members are about ⅜ inch thick. The means for bowing the side members should be capable of deflecting the middle of the side wall member by up to ½ inch or, in some cases, even more.

Since the flexing of the side wall members is accompanied by a small amount of longitudinal movement in the region of their ends, it is preferable to provide a rubbing seal to maintain the gap between the side members and independently mounted end members at such a value that surface forces prevent the escape of molten metal. In general it is considered that the maintenance of this gap at a value of 1/32 inch or below is sufficient to prevent such escape. In a preferred arrangement, the side wall members are biased against coacting surfaces on the end members and some form of roller bearing device is provided to permit the necessary amount of end movement.

Whilst it is usually preferred that the faces of the opposed side wall members of the mould should be truly parallel to the axis of ingot movement, it may in some instances be desirable to incline them slightly so that the gap between the outlet edges of the side wall members is slightly less than the gap at the inlet edges.

The provision of a mould with flexible side walls has various advantages in the direct chill semi-continuous casting process. In addition to the primary object of substantially eliminating butt-convexity, it enables ingots of different composition to be cast without change of mould. In conventional practice it is frequently necessary, when casting a different alloy, to change the mould for a mould of different convexity, because of the varying shrinkage characteristics of various alloys and different casting speeds employed. In a construction in which the side wall members and end wall members are separate from each other and the end wall members are movable towards and away from each other, one mould may be employed to cast a full range of ingots of different widths at the rolling face. By employing a series of end members of different facial width, ingots of different thicknesses may be cast with the same apparatus. In some instances a longitudinally tapered ingot may be desired. This may be produced by progressive inward or outward movement of the end members during the casting operation.

In one test ingots 18 × 42 inches for the production of aluminium sheet were produced. Various casting speeds and appropriate mould bows produced ingots with flat rolling faces. The following example was one such practice:

| | | |
|---|---|---|
| Volume of water | : | 100 gallons per minute |
| Casting speed | : | 2¾" per minute |
| Metal head | : | 3" |
| Basin temperature | : | 680°C |
| Furnace temperature | : | 695°C |

Casting started with straight parallel mould side walls and each was bowed out at the rate of 1/32 inch per 22 seconds until a bow of 12/32 inch per wall or 24/32 inch total bow was obtained.

An ingot of these dimensions, cast in a conventional mould, would have a butt-convexity of approximately ⅜ inch per face. However, as the width is increased, so is the convexity, so that, an ingot 18 × 80 inches would have more than ½ inch of convexity.

In other tests casting speeds up to 5 inches/minute have been employed. Very satisfactory results have been obtained at speeds up to 3¾ inches/minute. As in other D.C. casting procedures, it is found generally preferable to operate with small metal heads so as to ensure minimum delay between cooling by contact with the mould and cooling by means of coolant applied directly to the surface of the ingot below the mould (sub-mould cooling).

In another series of tests ingots for the production of rolled products and having the dimensions 18 × 56 inches were cast by the method of the present invention in three different alloys in accordance with the following practices.

| Alloy | Commercial Purity Al | Al-Mn 1% | Al-Mg 1% |
|---|---|---|---|
| Casting Speed | | | |
| Start | 1¾"/min. over 80 seconds | 1¾"/min. over 80 seconds | 1¼"/min. over 80 seconds |
| Increased | to 5"/min. during 180 seconds | to 5"/min. during 180 seconds | to 4¾"/min. during 180 seconds |
| Water Volume | | | |
| Start | 165 gal./min. over 80 seconds | 165 gal./min. over 80 seconds | 125 gal./min. over 80 seconds |
| Increased | to 200 gal./min. during 180 secs. | to 200 gal./min. during 180 secs. | to 200 gal./min. during 180 secs. |
| Mode of Application | | | |
| Constant during | 70 seconds | 70 seconds | 90 seconds |
| Changed during to pulsed on-off | 90 seconds | 90 seconds | 90 seconds |
| Cycle | 2 seconds | 2 seconds | 2 seconds |
| % off | 50% | 50% | 50% |
| Metal Head in Mould | 1¾ to 2⅛ ins. | 1¾ to 2⅛ ins. | 1¾ to 2⅛ ins. |
| Metal Temperature | 690 ± 5°C | 690 ± 5°C | 690 ± 5°C |
| Mould Opening Start | 100 secs. after casting start | 100 secs. after casting start | 120 secs. after casting start |
| Mould Opening Rate | ⅛"/min. per face for 7 mins. | ⅛"/min. per face for 7 mins. | ⅛"/min. per face for 7 mins. |

The ingots produced in these tests had acceptably flat surfaces at their butt ends.

The procedure of the present invention may be employed in conjunction with the procedure in U.S. Pat. No. 3,326,270, in which the upper parts of the mould surfaces of a continuous casting mould are lined with a flexible thermal insulation sheet material.

We have found that a particular advantage of the present invention is that it enables the shape of the ingot to be controlled where it has become necessary to reduce the casting speed. Reduction of casting speed may be required because of unscheduled increase in metal temperature or lack of metal supply. During the slowdown the formation of a convexity in the rolling faces of the ingot sides can be avoided by reducing the bow in the mould walls.

Referring now to the accompanying drawings:

FIG. 1 is a plan view of one form of mould constructed in accordance with the present invention, FIG. 2 is a section on A—A of FIG. 1, FIG. 3 is a section on B—B of FIG. 1, and FIG. 4 is a section on C—C of FIG. 1.

Although in the description of the accompanying drawings the invention is described with reference to an axially vertical mould, it is to be understood that the principles of the invention may be equally applied to an axially horizontal mould.

In the apparatus shown in FIGS. 1 to 4, the mould is provided with a co-operating stool, carrying a stool cap 2 and supported on a vertically movable base plate 3. The stool cap 2 initially closes the outlet end of the axially vertical mould in the conventional manner.

The mould is connected to and supported by a surrounding frame 4, which also constitutes a water header circuit. The mould itself is constituted by side wall members 5 and end wall members 6. Water jackets 7 extend substantially parallel to and serve to support the side wall members 5 and communicate with the water header conduit 4. The end wall members 6 (FIG. 3) are in the form of a simple water box, having an outlet slit 8 for directing water for sub-mould cooling. A flexible hose 9 connects the water box 6 with the header conduit 4. In this instance the end wall members 6 are stationary, being secured by studs 11 to cross members 10 connected between the water jackets 7. However, the end wall members 6 could be mounted so as to be longitudinally movable on guides by simple modification of the structure. This would permit variation of the width of the side faces of the ingot produced in the mould.

The side wall members 5 each consist of a thick strip of a heat conductive metal, preferably aluminium or copper, which is supported by a pair of links 12, slidably mounted in the wall of the water jacket 7, as shown in FIG. 2. The links 12 are connected to the side wall members 5 through swivel pins 14. At their outer ends the links 12 are connected to a yoke bar 15. The bowing or flexure of the side wall member is effected by means of a manually-actuated screw jack device 16, connected between the yoke bar 15 and an anchorage 17 on the frame 4. The amount of flexure is indicated by the co-operation of a pointer 18 and a scale 19 inscribed on the yoke bar 15. In order to achieve flexure of the side wall members 5 the ends of these members are restrained against outward movement by rollers 20 carried on brackets 21, which are adjustably secured to the end wall members 6 so as to permit adjustment of the width of the space between a roller 20 and the adjacent vertical edge of an end wall member 6. It will be noted also from FIG. 4 that the side wall members 5 are slidingly supported on guides 22 secured to end wall members 6.

The system for the application of coolant to the side wall members 5 and for the associated sub-mould cooling of the wide faces of the ingot is shown in FIG. 2. This consists of the already-mentioned water jacket 7, which has a series of closely spaced orifices 23, which are arranaged to direct water somewhat downwardly onto the reverse face of the side wall member 5. A deflector 24 is secured to the front of the water jacket 7 to check upward movement of water. The space between the side wall member 5 and water jacket 7 is closed off at the top by flexible sliding seal members 25 and 26, the water being free to escape downwardly after impinging on the reverse surface of side wall member 5 to perform its cooling function. The sub-mould cooling is achieved by the use of a spray pipe 27, having a series of orifices 28 positioned to direct water jets very close to the edge of the side wall member 5. The spray pipe 27 draws water from the water header conduit 4.

In operation the stool cap 2 initially closes the bottom of the mould cavity defined by the end wall members 6 and side wall members 5. At this stage the side wall members 5 are substantially unflexed so that the mould cavity has a substantially rectangular cross-section. The pouring of metal is then commenced and the lowering of the stool 1 is then performed in a conventional manner, that is to say, initially slowly during the formation of the butt end and then more rapidly. As the dropping rate of the stool 1 is increased the screw jack 16 is actuated to apply an amount of flexure which is dependent on the dropping rate and the characteristics of the metal being cast.

It will be understood that the stool constitutes the means for withdrawing the ingot from the mould and would be replaced by other conventional structures when a mould in accordance with the invention is arranged with its axis in a horizontal or inclined position.

It will be appreciated that the supply of metal to the mould may be effected in any convenient way, i.e. via a conventional float-controlled dip tube or other conventional metal feeding devices employed in the art to maintain a substantially constant metal head during the casting operation.

We claim:

1. Procedure for direct chill semi-continuously casting a substantially rectangular-section metal ingot including the steps of a. supplying molten metal to the inlet end of a mould having an open outlet end and a substantially rectangular passage therethrough and maintaining a head of molten metal in said mould during said casting operation, b. cooling the mould for solidifying the peripheral portion of the metal therein, c. advancing the ingot through the mould at a relatively low initial speed and then increasing the rate of advance of the ingot through the mould, d. applying coolant directly to the surface of the ingot emerging from said mould, wherein the improvement comprises increasing the gap at least between the mid-points of the opposed longer sides of the rectangular mould without substantial alteration of the gap between said sides at the ends thereof when the rate of advance of the ingot through the mould is increased above the relatively low initial speed whereby the sides of the solidified ingot are controlled to an acceptable condition of flatness throughout their length.

2. Procedure according to claim 1 further including progressively increasing the curvature of the walls of said longer sides to increase the gap between the mid-points of said sides.

3. Procedure according to claim 1 further including subsequently reducing the rate of advance of the ingot through the mould and simultaneously reducing said gap from its increased size.

* * * * *